US011333101B2

(12) United States Patent
Schmitt

(10) Patent No.: US 11,333,101 B2
(45) Date of Patent: May 17, 2022

(54) FLOATING HEAD PISTON ASSEMBLY

(71) Applicant: THERMAL TECH HOLDINGS, Westport, CT (US)

(72) Inventor: Joshua M. Schmitt, San Antonio, TX (US)

( * ) Notice: Subject to any disclaimer, the term of this patent is extended or adjusted under 35 U.S.C. 154(b) by 0 days.

(21) Appl. No.: 16/963,080

(22) PCT Filed: Jan. 10, 2019

(86) PCT No.: PCT/US2019/013050
§ 371 (c)(1),
(2) Date: Jul. 17, 2020

(87) PCT Pub. No.: WO2019/143520
PCT Pub. Date: Jul. 25, 2019

(65) Prior Publication Data

US 2020/0347799 A1 Nov. 5, 2020

Related U.S. Application Data

(60) Provisional application No. 62/619,689, filed on Jan. 18, 2018.

(51) Int. Cl.
*F02G 1/053* (2006.01)
*F01K 25/00* (2006.01)
*F02G 1/044* (2006.01)

(52) U.S. Cl.
CPC ..... *F02G 1/053* (2013.01); *F01K 25/00* (2013.01); *F02G 1/044* (2013.01)

(58) Field of Classification Search
CPC ..... F02G 1/053; F02G 1/044; F01K 25/00; F01K 25/103; F01K 25/08; F01K 7/36; F01B 11/001
USPC ..... 60/520; 91/4 R, 4 A
See application file for complete search history.

(56) References Cited

U.S. PATENT DOCUMENTS 3,100,965 A * 8/1963 Blackburn ..... F02K 9/72 60/375
3,151,533 A * 10/1964 Hartel ..... B64C 25/505 91/4 R
3,192,717 A * 7/1965 Lee ..... F01L 21/02 60/371

(Continued)

FOREIGN PATENT DOCUMENTS

CN 103195606 * 8/2015
EP 1470014 * 4/2006

*Primary Examiner* — Hoang M Nguyen
(74) *Attorney, Agent, or Firm* — Law Office of William F. Ryann

(57) ABSTRACT

An assembly with a piston reciprocated with the aid of a floating head in fluid communication with the piston. The assembly may utilize a floating head that is shifted in position to promote reciprocation of the piston through the aid of pressure supplied to the floating head from a pressure volume regulator. Alternatively, the floating head may be in fluid communication with the piston at one side of the head and isolated at the other side. In this manner changing volume and pressure at this other side of the head during reciprocation may ultimately lead to floating head movement toward the piston, thereby promoting the continued reciprocation. Additional efficiencies may also be realized through unique hydraulic layouts for both operating and working fluid circulations.

17 Claims, 8 Drawing Sheets

(56) References Cited

U.S. PATENT DOCUMENTS

| | | | | |
|---|---|---|---|---|
| 3,901,033 | A * | 8/1975 | McAlister | F04F 1/10 60/516 |
| 4,195,481 | A * | 4/1980 | Gregory | F01B 21/00 60/514 |
| 6,470,683 | B1 * | 10/2002 | Childs | B01D 61/025 60/39.6 |
| 8,733,300 | B2 * | 5/2014 | Buchanan | F01K 21/04 123/19 |
| 2009/0140475 | A1 * | 6/2009 | Turner | B60G 17/08 267/64.15 |
| 2011/0041506 | A1 * | 2/2011 | Johnston | F01K 25/10 60/670 |

* cited by examiner

FLOATING HEAD PISTON ASSEMBLY

BACKGROUND

Over the years, efforts have been undertaken to obtain power through different thermodynamic cycles. For example, techniques for generating electrical power from equipment relying on the "Brayton", "Stirling" or "Organic Rankine" cycle (ORC) have been developed. Unfortunately, these technologies have been generally ineffective and inefficient with lower heat sources, for example, below the boiling point of water.

By way of example, ORC equipment or engine manufacturers often provide a system that allows for practical operation with input heat temperatures as low as 170° F. However, as a result, this may only be rendered where a dramatically reduced output is also attained, thereby making the undertaking significantly less economical. In part, this is due to the fact that the method of operation uses two phase changes per cycle, from liquid to gas and back again, and uses turbine or turbine-like technology to convert the pneumatic forces of the gas to generate productive work.

Alternative technologies for converting very low grade heat into usable work also exist. Very low grade heat is defined herein as being below the boiling point of water at sea level. Regardless, these technologies are generally inefficient or unproductive as well. Again, most of these technologies are also based on the Organic Rankine thermodynamic cycle, which involves converting a liquid to a gas and back again. That is, two phase changes per cycle are exhibited. Therefore, these "thermal pneumatic heat engines" face a challenge in terms of efficiency.

ORC engines convert a liquid with a low boiling temperature, such as a refrigerant, to gas and then channels the gas, or a gas and liquid mixture, through a turbine-like device to produce rotary motion. Such engines operate at a "low" rotational speed of near 5,000 rpm. The gas mixture is then cooled back to a liquid state, changing phase again before reuse. Even setting aside these naturally occurring phase change inefficiencies, such speed and phase changes create significant noise, not unlike a jet engine.

Another technology that has been attempted is known as "thermal hydraulic heat engines". These involve the use of heat applied to a liquid that may have a relatively high coefficient of expansion. As a practical matter, however, most liquids expand very little when heated and contract very little when cooled. Thus, in actual practice, such engines fail to attain successful commercialization due primarily to the difficulty of obtaining sufficient expansion, and sufficiently rapid expansion and contraction, in liquids, which in turn limits the economic viability of such engines. Further, even when utilized, such engines are only practical for use in a narrow set of specific circumstances given the general inflexibility in terms of available modifications for differing uses. In fact, extensive trial and error is generally required even for the circumstances in which the engines may be effectively utilized. This is due, in part, to the inherent limitation involved with relying on the expansion and contraction of a liquid by the introduction and removal of heat.

These types of engines generally include the use of a piston that is reciprocated by the alternating application of heated gas and cooled liquid, comparatively speaking. As a result, the piston is well suited for reciprocation in a linear manner. Thus, in theory, the added efficiencies of linear reciprocation may be available in generating work. However, as a practical matter, the ability to efficiently obtain work from such a linear reciprocating piston faces added challenges. That is, in addition to phase change and other engine inefficiencies that are commonplace with other thermal heat systems as noted above, as with any linearly reciprocating piston, a complete stop and reverse in direction is required with every stroke. However, due to the use of generally low input temperatures in facilitating stroking of the piston, the piston may face efficiency challenges with each stroke. This is because the piston reaching the end of a stroke must overcome forces from one direction for stroking in the opposite direction facilitated only by generally low input temperatures, generally below about 200° F.

SUMMARY

A piston assembly is provided for a thermal cycle engine. The assembly includes a piston with a head defining an operating chamber for changing in volume. A floating head is also included which defines a compressible chamber and is in hydraulic communication with the operating chamber to enhance reciprocation of the piston. Additionally, the compressible chamber volume is dynamically dependent upon the operating chamber volume. In one embodiment, the operating chamber is defined by the piston head at one side whereas the floating head itself defines the other side of the chamber. In another embodiment, the operating chamber is actually a first operating chamber and the hydraulic communication with the floating head includes a tubular connection from the first operating chamber to a second operating chamber defined by the floating head at a location apart from the first operating chamber.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described. For example, embodiments herein are described with reference to illustrations depicting a certain floating dual-head piston assembly system or engine. However, a variety of layouts may be employed, with additional piston assemblies incorporated, a host of additional valving or timing controls, etc. However, these system/engine layouts are merely illustrative as a variety of different hydraulic or even mechanical layouts and other design options may be employed depending on system constraints and the intended application.

Embodiments detailed herein may use the controlled expansion and contraction of a compressible fluid, perhaps supercritical fluid, to move a piston in order to generate productive work. While it is not required that the operating fluid be a supercritical fluid, the system may govern a thermodynamic cycle similar to embodiments detailed in U.S. Provisional Patent Application 62/424,494 for a Thermal Cycle Engine and PCT/US17/60722 for a High Dynamic Density Range Thermal Cycle Engine, each of which is incorporated herein in its entirety. For example, the engine may display a "low" reciprocation speed of less than about 50 cycles per minute. Further, embodiments detailed herein may avoid changes in phase, and so are inherently more thermodynamically efficient, and with the appropriate operating fluid may operate effectively using input temperatures below 200° F. In fact, they can easily be tuned to operate with minor reductions in efficiency with input heat below 150° F. It also operates with greatly reduced noise.

As indicated, the embodiments detailed herein do not require the circulation of supercritical fluid. Additionally, a more complete circulation of the supercritical fluid may be utilized as detailed in U.S. Provisional Patent Application 62/618,689, for a Floating Head Opposing Piston Assembly, which is incorporated herein by reference in its entirety. In these embodiments, a unique floating head may be employed adjacent to a piston head to provide a sequentially timed, spring-like aid to filling the working fluid chamber and stroking of a piston for enhanced efficiency thereof.

Figure 1:
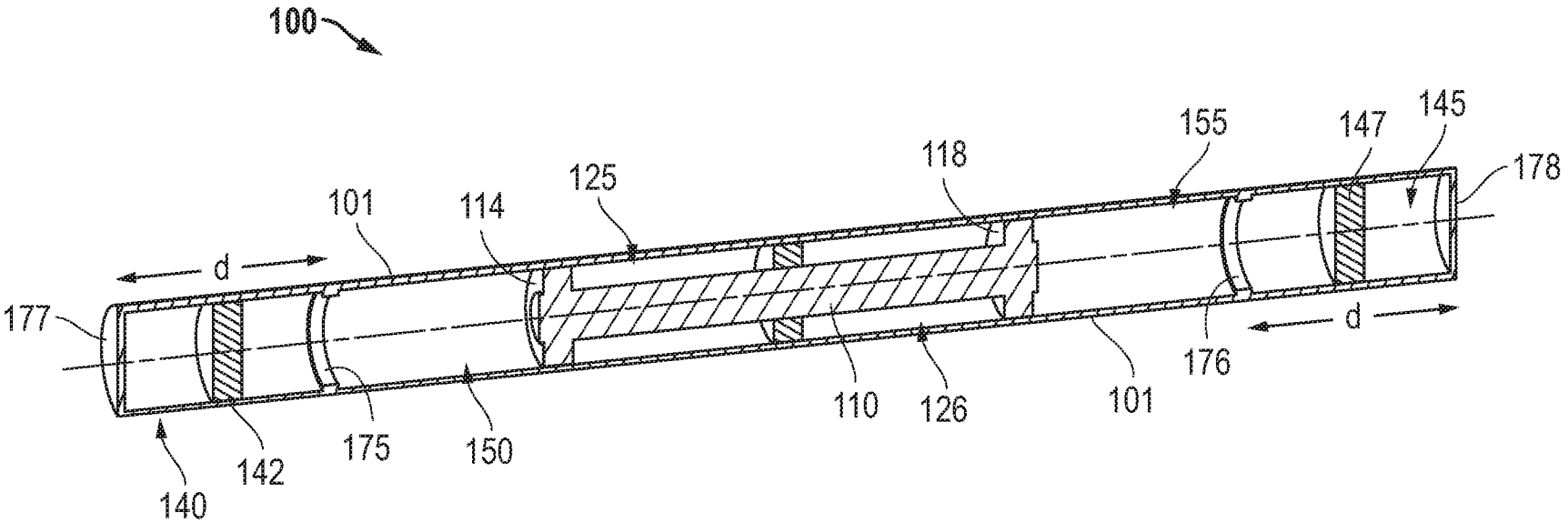
FIG. 1 is a side perspective view of a unitary embodiment of a floating head piston assembly.

Referring specifically now to FIG. 1, a side perspective view of a unitary embodiment of a floating head piston assembly 100 is shown. In this embodiment, a working piston 110 shares the same monolithic housing 101 with floating pistons 142, 147. The housing 101 may be of single construction or separately joined segmented pieces. For example, separate casings, one for each floating head 142, 147 and another for the working piston 110 may be separately constructed and welded together. Regardless, for the embodiment shown, a unitary character is displayed by the monolithic housing 101 without the requirement of any hydraulic lines to support fluid communication between the working piston 110 and the floating pistons 142, 147. However, in other embodiments, a non-unitary, hydraulic line supported communications may be employed for sake of design flexibility (e.g. depending on available foot-space) (see FIGS. 2A and 2B).

As detailed further herein, the assembly 100 is constructed such that reciprocation of the working piston 110 is used to alternatingly change the volumes of intermediate chambers 125, 126. In this way, an incompressible working fluid such as hydraulic oil may be alternatingly circulated out of the chambers 125, 126 through working hydraulics 400 and directed toward a motor 430, flywheel 440, generator 450 or other suitable power retrieval device (e.g. see FIGS. 4A and 4B).

Reciprocation of the piston 110 as described above is driven by the alternating introduction of operating fluid into adjacent chambers 150, 155 defined by working piston heads 114, 118. As detailed further below, the operating fluid may be a supercritical fluid such as $CO_2$ or other appropriate fluid, generally one that is effectively circulated by way of efficient heating and cooling cycles. Regardless, as operating fluid is used to increase the volume of the upper adjacent chamber 150, the volume of the upper intermediate chamber 125 is reduced, forcing working fluid out of the intermediate chamber 125 as noted above and toward a power retrieval device. By the same token, as the piston 110 is reciprocated in the opposite direction, due to influx of operating fluid into the lower adjacent chamber 155, the volume of the lower intermediate chamber is compressibly reduced, again forcing working fluid out and toward a power retrieval device.

Continuing with reference to FIG. 1, reciprocation of the working piston 110 is aided by the addition of floating heads 142, 147 which define the opposite side of the adjacent chambers 150, 155. These floating heads 142, 147 may travel along a distance (d) between head stops 175, 176 and capped ends 177, 178 of the assembly 100. Thus, the volume of the adjacent chambers 150, 155 is defined by the piston heads 114, 118 as noted above as well as the position of the floating heads 142, 147. It is the concept of the floating head 142, 147 which affords the assembly 100 an enhanced efficiency in terms of pressure and volume regulation at the adjacent chambers 150, 155. This allows control over the state of the fluid as it leaves chambers 150, 155. If the fluid leaves at elevated temperature, its heat energy can be recovered into the cycle via a heat exchanger, making a more efficient thermal cycle. As a result, the continued reciprocation of the piston 110 and ultimately the work attained therefrom occurs at a more enhanced and comparatively more consistent and smoother rate.

In one embodiment, the floating chambers 140, 145 may be alternatively increased in volume, for example, by introduction of hydraulic oil or other suitable incompressible fluid from a nearby accumulator or other suitable location. Thus, a chamber 140 may be increased in volume with the head 142 forced along the distance (d) toward the upper adjacent chamber 150 to aid in smooth controlled stroking of the piston 110 (to the right as shown). In turn, working fluid may be circulated out of the upper intermediate chamber 125 as described above. Aid to circulating of the operating fluid out of the upper adjacent chamber 150 is also provided as a result of the movement of the floating head 142 in this manner. This embodiment of floating head actuation and circulation of operating and working fluids is detailed further below with specific reference to FIGS. 3 and 4A-4D, respectively.

In another embodiment, the movement of the floating heads 142, 147 may be a function of pressure where the floating head chambers 140, 145 are sealed off and isolated without hydraulic connection to any outside pressure source. For example, a chamber 140 may be filled with a compressible gas such as nitrogen, air or an inert gas of a predetermined pressure sufficient for holding the head 142 at the head stop 175, say about 1,500 psi. Thus, this feature may be referred to as a "gas" or an "air" spring as noted below. Regardless, as an adjacent chamber 150 is expanded by circulation of operating fluid thereinto, for example moving this chamber 150 from a starting psi of about 1,100 to over 1,500 psi, the corresponding floating head chamber 140 may decrease in volume and increase in pressure. However, once the pressure in this chamber 140 matches and/or exceeds pressure in the adjacent chamber 150, for example, with both reaching about 3,000 psi, the head 142 will be driven back toward the adjacent chamber 150, increasing pressure therein to provide an added kick for redirecting of the piston 110 in the opposite direction. Of course, these pressures are only meant to be illustrative as any suitable range of pressure options may be employed.

Recall now that the operating fluid which acts upon the piston 110 to drive reciprocation thereof may be a non-supercritical fluid, or a supercritical operating fluid such as $CO_2$, helium or perhaps supercritical steam or other suitably efficient temperature effective fluid. That is, the fluid may be circulated through states of high temperature and pressure to states of low temperature and pressure, ultimately producing work. The addition of the described floating head concept provides an energy storage and recovery device, illustratively referred to as a "gas spring" or an "air spring", to the system which enhances the efficiency of this circulation. This accumulator is initially kept at a set pressurization as indicated with a resulting temperature. However, the release of this spring upon pressurization and subsequent depressurization of the adjacent chamber helps regulate supercritical fluid circulation as indicated. In the embodiment where the floating head chamber 140 (or 145) is isolated, this action will maintain roughly a constant temperature condition in the gas of the chamber 140, improving the efficiency of the work produced by the cycle.

Figure 2A:
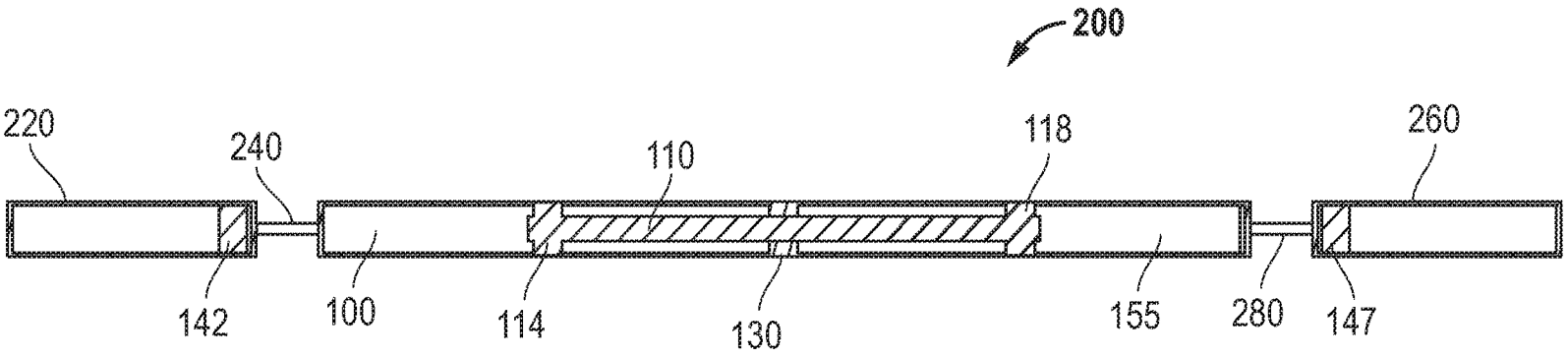
FIG. 2A is a schematic representation of a segmented embodiment of a floating head piston assembly.
Figure 2B:
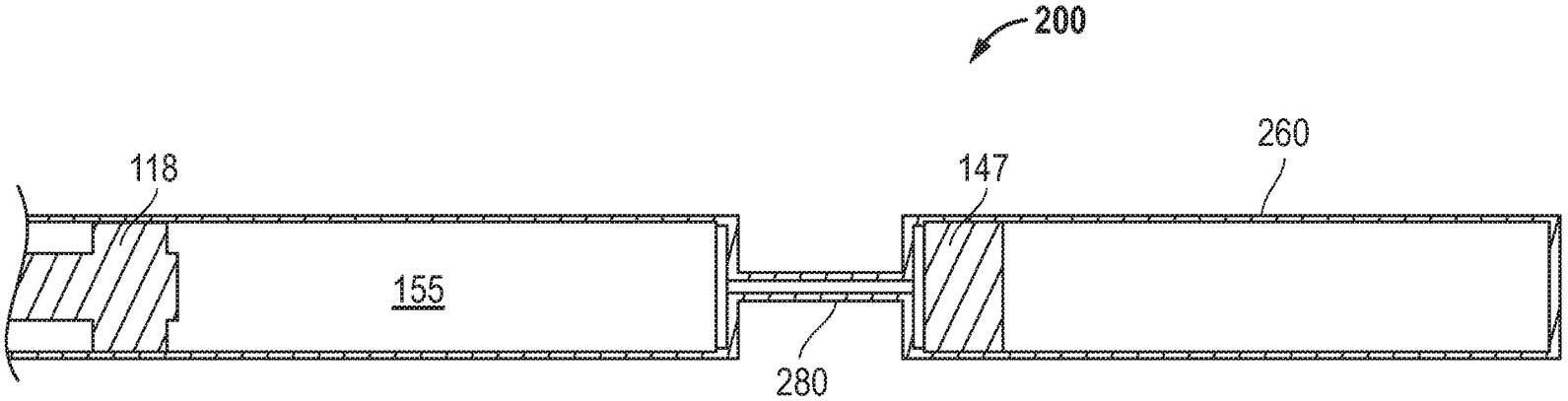
FIG. 2B is an enlarged view of a portion of the schematic representation of the segmented embodiment of FIG. 2A.

Referring now to FIGS. 2A and 2B, a schematic representation of a segmented embodiment of a floating head piston assembly 200 is shown. In this embodiment, the piston 110 is housed separately from the floating heads 142, 147. More specifically, the heads 142, 147 are housed at discrete head chambers 220, 260 apart from the remainder of the assembly 200. Hydraulic lines 240, 280 are used to provide fluid communication between the heads 142, 147 and the adjacent chambers 150, 155. In the embodiment shown, the floating heads 142, 147 are positioned at the side of the head chambers 220, 260 closest to the adjacent chambers 150, 155. However, as the heads 142, 147 move away from the adjacent chambers 150, 155, the fluid volume increases between the heads 142, 147 and the piston heads 114, 118. In this manner, the segmented embodiment of the assembly 200 differs slightly from the more unitary embodiment of FIG. 1. That is, the effective volume of the adjacent chambers 150, 155 is increased by the volume of the lines 240, 280 and by any exposed head chamber volume when a floating head 142, 147 shift to positions away from the adjacent chambers 150, 155. That said, the operating principles as detailed herein remain effectively the same.

The more material distinctions of the segmented embodiment of the assembly 200 of FIGS. 2A and 2B may be found in terms of flexibility and options provided. For example, depending on where the assembly 200 is to be utilized at an industrial site, there may be foot-space limitations. However, the depicted embodiment allows for segmentation. Thus, the head chambers 220, 260 may be located in a separate location from the remainder of the assembly 200 with the hydraulic lines be extensive in length and flexibility if need be to provide the described hydraulic communications. As a practical matter, this may add to design flexibility and increase cost effectiveness for operations in an overall system.

Another distinction for the embodiments of FIGS. 2A and 2B may be found in the presence of the lines 240, 280. The introduction of such tubular elements may present flow restrictions. In an embodiment where low rotational motor speeds are to be attained from the assembly 200 such restrictions may be negligible, particularly where an accumulator 490 is provided for pressure and volume regulation (e.g. see FIG. 4B). Indeed, the diameter of the lines 240, 280 may also be selected to minimize flow restriction. Alternatively, in an embodiment where flow restriction is desirable, the introduction of lines 240, 280 may be taken advantage of as a matter of providing additional tailored design options.

Figure 3:
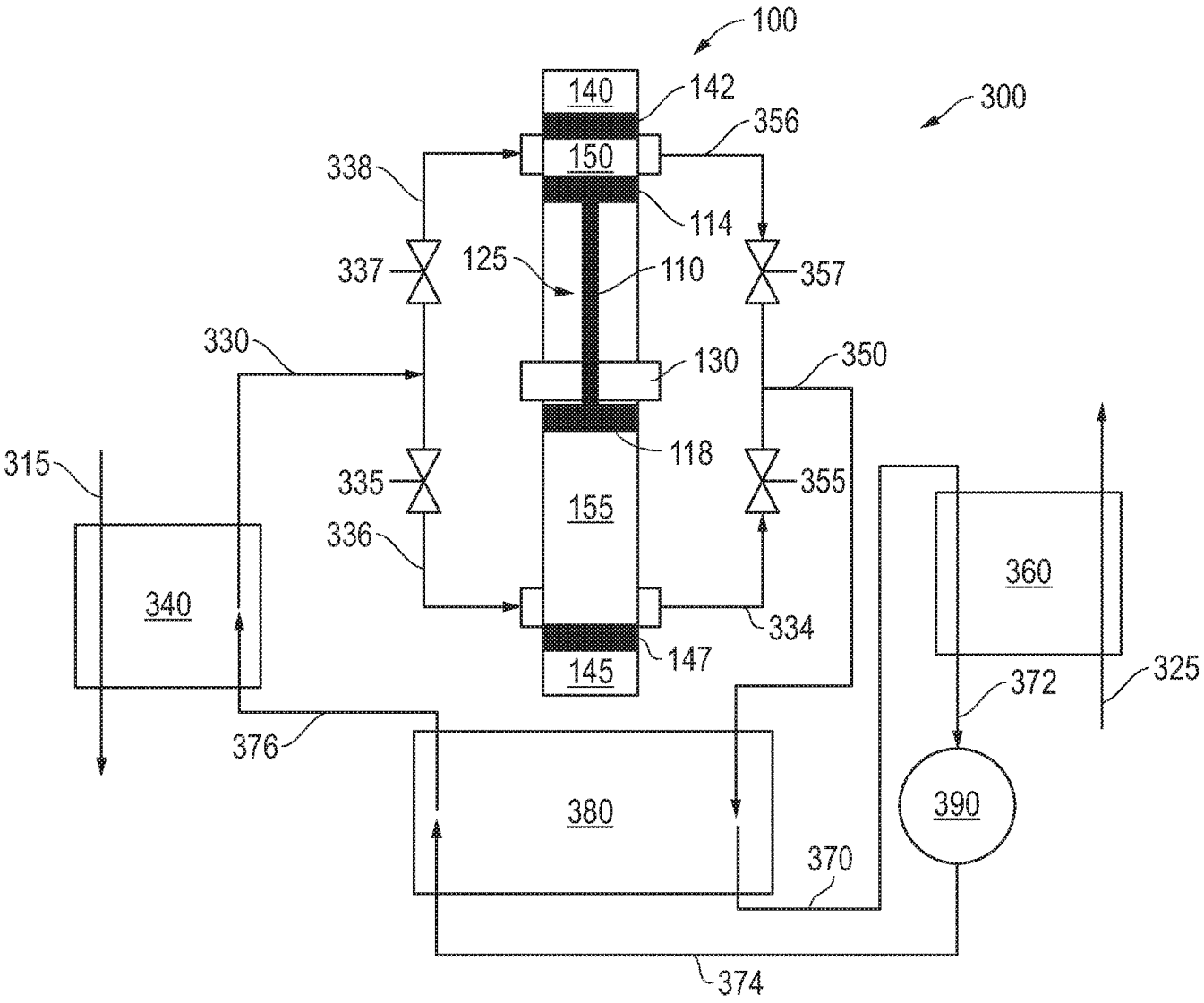
FIG. 3 is a schematic representation of a system employing a circulating operating fluid to direct reciprocation of the floating head piston assembly of FIG. 1.

Referring now to FIG. 3, a schematic representation of a system 300 is shown employing a circulating operating fluid to direct reciprocation of the floating head piston assembly 100 of FIG. 1. That is, in this view, an embodiment of a hydraulic layout is shown for the operating fluid as it is employed to reciprocate the piston 110. This is in contrast to the corresponding hydraulic layout for the working fluid which ultimately supplies power, for example, as shown in the embodiments of FIGS. 4A-4D.

As with the piston assembly 100 of FIG. 1, floating heads 142, 147 are provided to facilitate enhanced reciprocation of the piston 110. For example, in the embodiment shown, an operating fluid such as heated supercritical $CO_2$ has been routed from a heat exchanger 340 along line 330 which hydraulically links to heat side valves 335, 337. Thus, the operating fluid may be alternatingly routed to one of the upper 150 and lower 155 adjacent chambers of the piston assembly 100 to drive reciprocation thereof.

As illustrated, a heat flow 315, for example, heated water may be used to maintain heat of the heat exchanger 340. In one embodiment, maintaining the heat flow may be done by any of a number of low grade heat sources. For example, geothermal heat, solar heat or the waste heat from other unrelated system operations may be utilized to maintain the flow 315 at between about 100° F. and 200° F. This allows for an effective and economical utilization of a vast array of heat sources previously considered to be too cool and of no practical economic value. Of course, in other embodiments, higher temperatures may be utilized.

As shown in FIG. 3, the upper intermediate chamber 125 is about maximized in volume with the lower intermediate chamber 126 of FIG. 1 only negligibly apparent. Thus, the working fluid has been forced out of the lower intermediate chamber and directed toward power retrieval device(s) as discussed further below. This means that the lower heat side valve 335 has been open directing operating fluid toward the lower operating chamber 155 while the upper heat side valve 337 has been closed. Also apparent is the aid provided by the lower floating head 147 in moving toward the lower operating chamber 155 at the outset of the stroking of the piston 110 in an upward direction as discussed above.

Of course, in this same timeframe, the upper cold side valve 357 is opened with the lower cold side valve 355 remaining closed. Additionally, the upper floating head 142 may responsively begin to move upward as it slightly lags behind the upward movement of the piston 110 and upper head 114. Nevertheless, as noted above, this head 142 may also respond to a pressure buildup in the upper floating chamber 140, whether through pressurized air or the introduction of another working fluid, to initiate stroking of the piston 110 in the opposite direction following the depicted timeframe. In connection with this, the upper cold side valve 357 will be closed as the lower 355 is opened to accommodate the flow of operating fluid therethrough.

Continuing with reference to FIG. 3, the operating fluid is routed to a cold exchanger 360. In the embodiment shown, a recuperator 380 is first introduced into the flow of the operating fluid before reaching the cold exchanger 360. The recuperator 380 may circulate operating fluid at an intermediate temperature, between that of the heat exchanger 315 and that of the cold exchanger 360. Thus, a more consistent and efficient temperature drop may be displayed by the operating fluid before it reaches the cold exchanger 325.

Furthermore, the heat is recovered into the operating fluid after the pump 390, requiring less heat exchange from heat exchanger 340, thus improving cycle efficiency. In the embodiment shown, a cold flow 325 may be used to facilitate heat removal from the operating fluid by the cold exchanger 360. This flow 325 may be drawn from room temperature water, evaporative cooling or other suitable means.

The cooled operating fluid, perhaps supercritical $CO_2$ that has been cooled from about 175° F. down to about 150° F., may then be pumped by an exchange pump 390 back through the recuperator 380 and eventually to the heat exchanger 340. Thus, the circulating of the operating fluid to the piston assembly 100 for stroking of the piston 110 may be continued as described above.

Referring now to FIGS. 4A-4D, schematic representations of the system 300 of FIG. 3 are shown which highlight the hydraulics involved in the circulating of the working fluid as directed by the reciprocation of the piston 110 as described above. With specific reference to FIG. 4A, the piston 110 of the assembly 100 is shown in a first upper position with the upper floating head 142 about to move upward (arrow 424). However, as also discussed above, this will pressurize or "charge" the upper floating chamber 140 which will subsequently provide an added force or kick for redirecting the piston 110 in the opposite downward direction. Indeed, in the embodiment shown, an accumulator 490 is provided which may be used to direct a working fluid to this chamber 140 at the appropriate time to ensure a controlled sufficient added force is provided through a downward movement of the floating head 142.

Figure 4A:
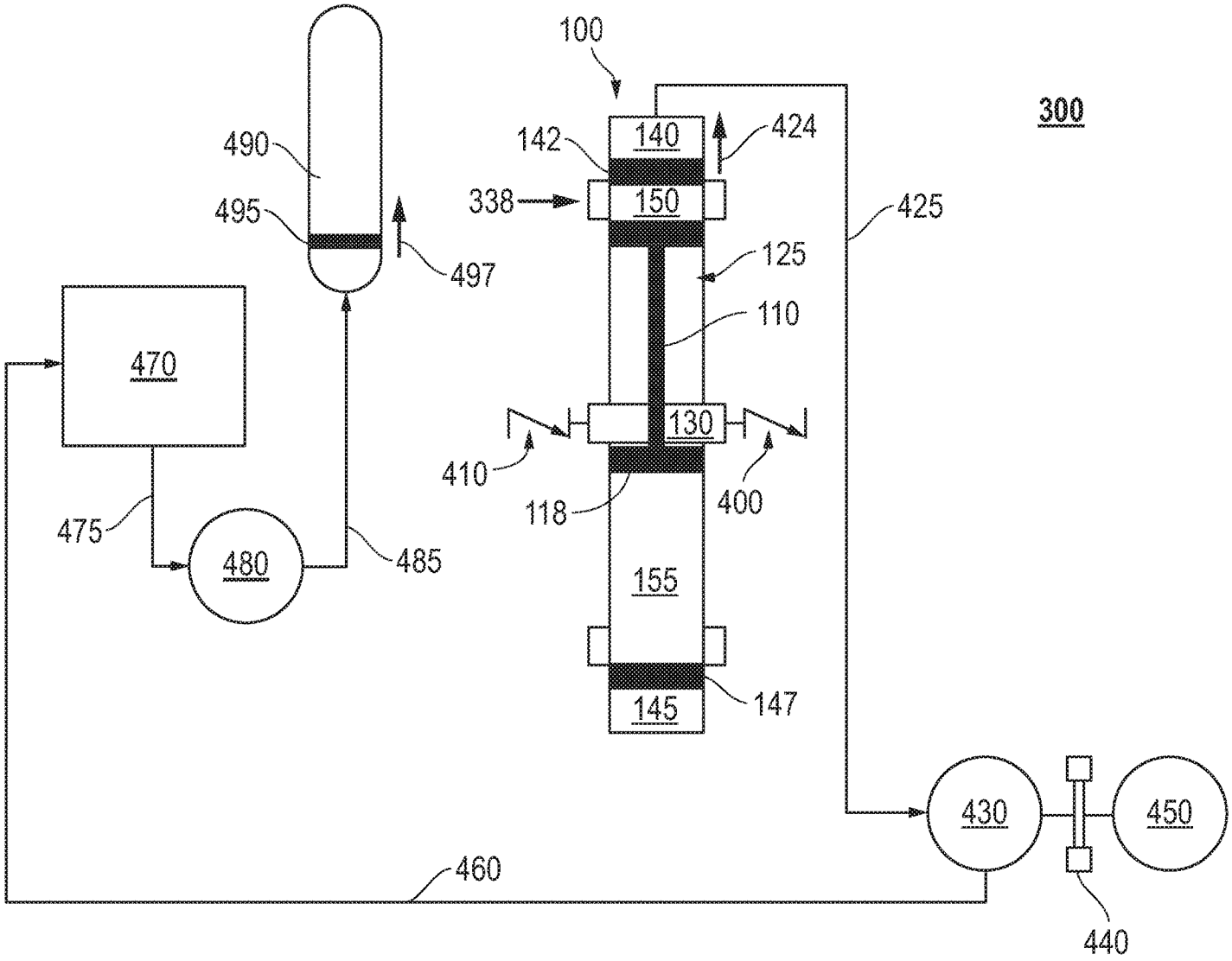
FIG. 4A is a schematic representation of the system of FIG. 3 employing a circulating working fluid with a piston of the assembly in a first upper position.

Continuing with reference to FIG. 4A, the circulating of the operating fluid, detailed above with respect to FIG. 3, is used to continuously circulate working fluid from the assembly (arrow 400). In this way, a working fluid may ultimately be directed to power retrieval devices as detailed further below (e.g. 430, 440, 450). However, a variety of other efficiencies may be realized in the circulating of the working fluid in the embodiment shown. For example, in an embodiment where the upper floating chamber 140 employs working fluid, this fluid may also be directed toward power retrieval devices 430, 440, 450 as the floating head 142 is being set by movement upward (424) prior to being utilized as an aid in redirecting the piston 110 in the opposite direction.

Additionally, a portion of this working fluid may be directed from the location of the power retrieval devices 430, 440, 450 to a reservoir 470. For example, where the devices 430, 440, 450 are sufficiently provided for already, a portion of the working fluid may be directed to the reservoir 470 making it available to the accumulator 490 for pressurizing upper floating chamber 140 as described above (or the lower floating chamber 145 (as described below). In the embodiment shown, an accumulator pump 480 is provided to help facilitate drawing on the reservoir 470 in charging the accumulator 490. Note, the upward movement of the accumulator piston 495 as the accumulator 490 is charged (arrow 497).

Figure 4B:
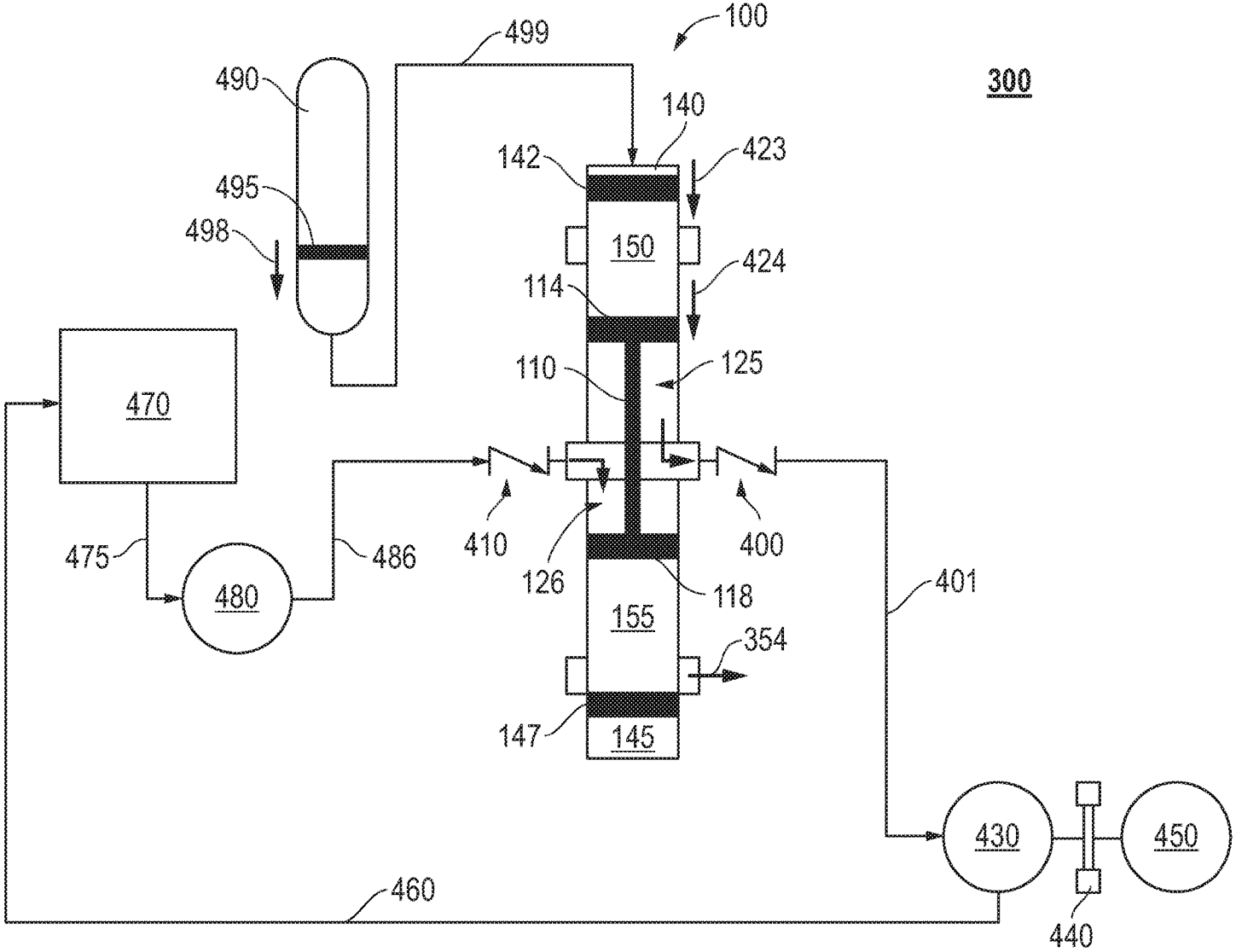
FIG. 4B is a schematic representation of the system of FIG. 4A as the volume of an upper intermediate chamber is decreased by the piston to circulate working fluid therefrom.

Referring now to FIG. 4B a schematic representation of the system of FIG. 4A is shown as the circulation of hydraulic oil continues. Specifically, in this view, the volume of the upper floating head chamber 140 is decreased following the upward stroke of the piston 110 and the increase in pressure within the upper adjacent chamber 150. As described above, the pressure in the floating head chamber 140 will now be increased. In the embodiment shown, this increase is aided by the supplemental pressure provided by the accumulator 490. In this respect, the accumulator serves as a pressure and volume regulator of this chamber 140. In turn, this floating head 142 may be moved toward the piston 110 (arrow 423), increasing the pressure in the adjacent chamber 150 and forcibly directing the piston 110 back in the other direction (arrow 424). In this illustration, notice the movement of the accumulator piston 495 downward (arrow 498) to support the kick or "spring" effect of the upper floating piston 142 in the downward direction (arrow 423) as described above.

Continuing with reference to FIG. 4B, also notice the circulating out 400 of working fluid from the upper intermediate chamber 125 in response to the downward movement 424 of the working piston head 114. Indeed, the same will subsequently be true with respect to the lower intermediate chamber 126 in response to the upward movement of the lower working piston head 118. In either case, the working fluid is circulated out of the assembly 100 and toward power retrieval devices 430, 440 and 450. For the embodiments shown, this is the primary manner of routing the working fluid to these devices 430, 440, 450 for ultimately obtaining power from the system 300. Of course, as previously noted, a portion of this working fluid may also be redirected to a reservoir 470 and made available to the accumulator 490 when not needed by the devices 430, 440, 450. By the same token, working fluid at the reservoir 470 that is not needed by the accumulator 490 may be recirculated right back to the assembly 100 at 410 with the aid of the accumulator pump 480.

Figure 4C:
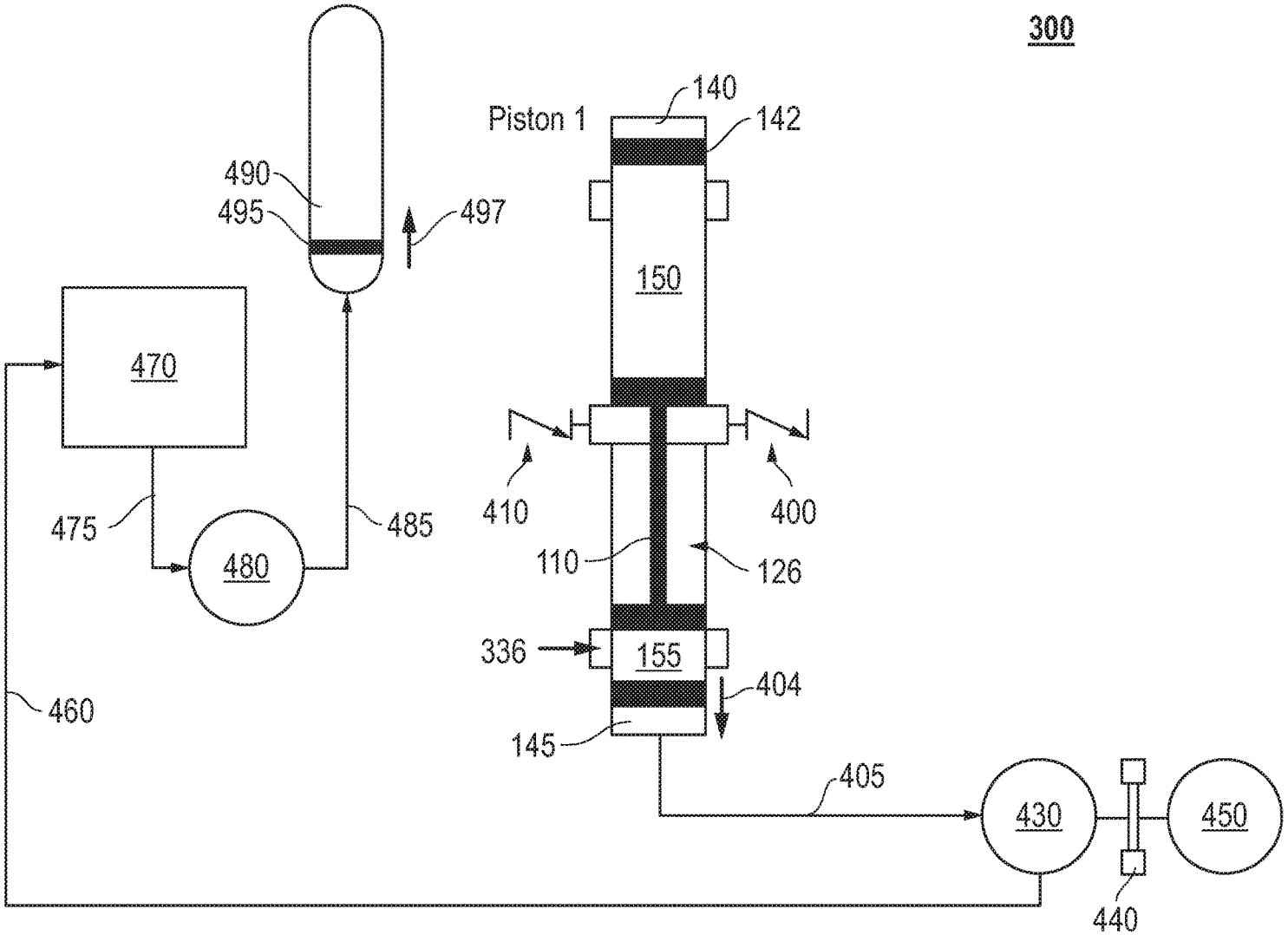
FIG. 4C is a schematic representation of the system of FIG. 4B with the piston substantially closing the working chamber.

Referring now to FIG. 4C, a schematic representation of the system 300 is shown with the piston 110 substantially closing the upper intermediate chamber 125 of FIG. 4B. This has been achieved with the aid of the upper floating head 142. It is apparent now that the lower floating head 147 may be shifted downward (arrow 404) in response to the corresponding increasing pressure of the lower adjacent chamber 155 as a result of the downward movement of the piston 110. As with the upward shift of the upper floating head 142, the downward shift of the lower floating head 147 may be employed to direct working fluid to the power retrieval devices 430, 440, 450 (e.g. along hydraulic line 405). Further, a portion of this working fluid may also be redirected from these devices 430, 440, 450 to the reservoir 470 as described above.

Figure 4D:
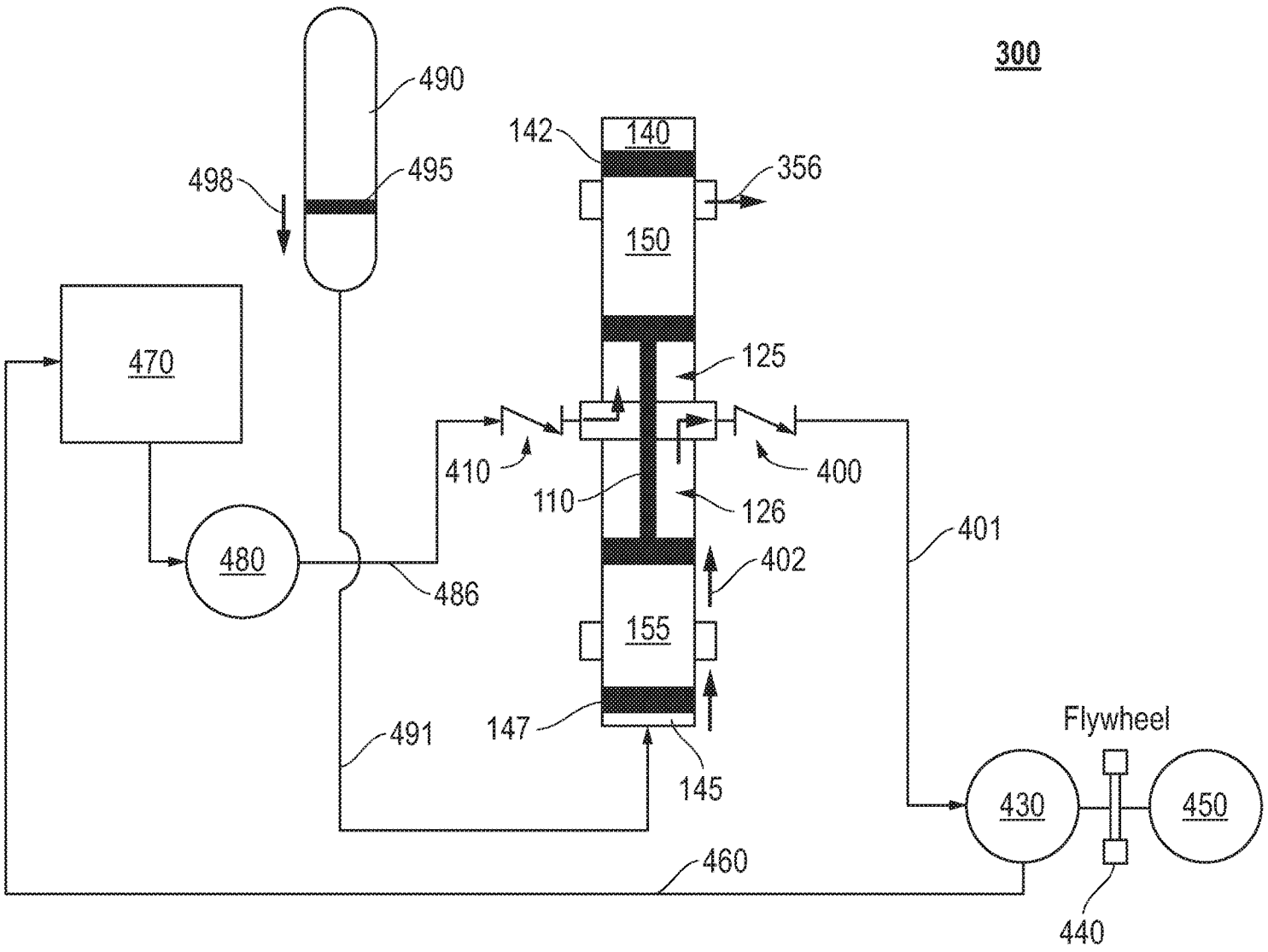
FIG. 4D is a schematic representation of the system of FIG. 4C with a lower floating head moving upward to facilitate the piston in decreasing a volume of a lower working chamber to circulate working fluid therefrom.

Referring now to FIG. 4D, at some point, the piston 110 may be ready for stroking upward again (see arrow 402). With the lower floating head 147 fully shifted downward and the pressure in the lower floating head chamber 145 at a maximum it is similarly ready to stroke upward to provide air spring like assistance to the upstroke of the piston 110. As with the upper floating head 142, this movement may be facilitated by the accumulator 490. Note the movement of the accumulator piston 495 in the downward direction 498 to provide this assistance.

Figure 5:
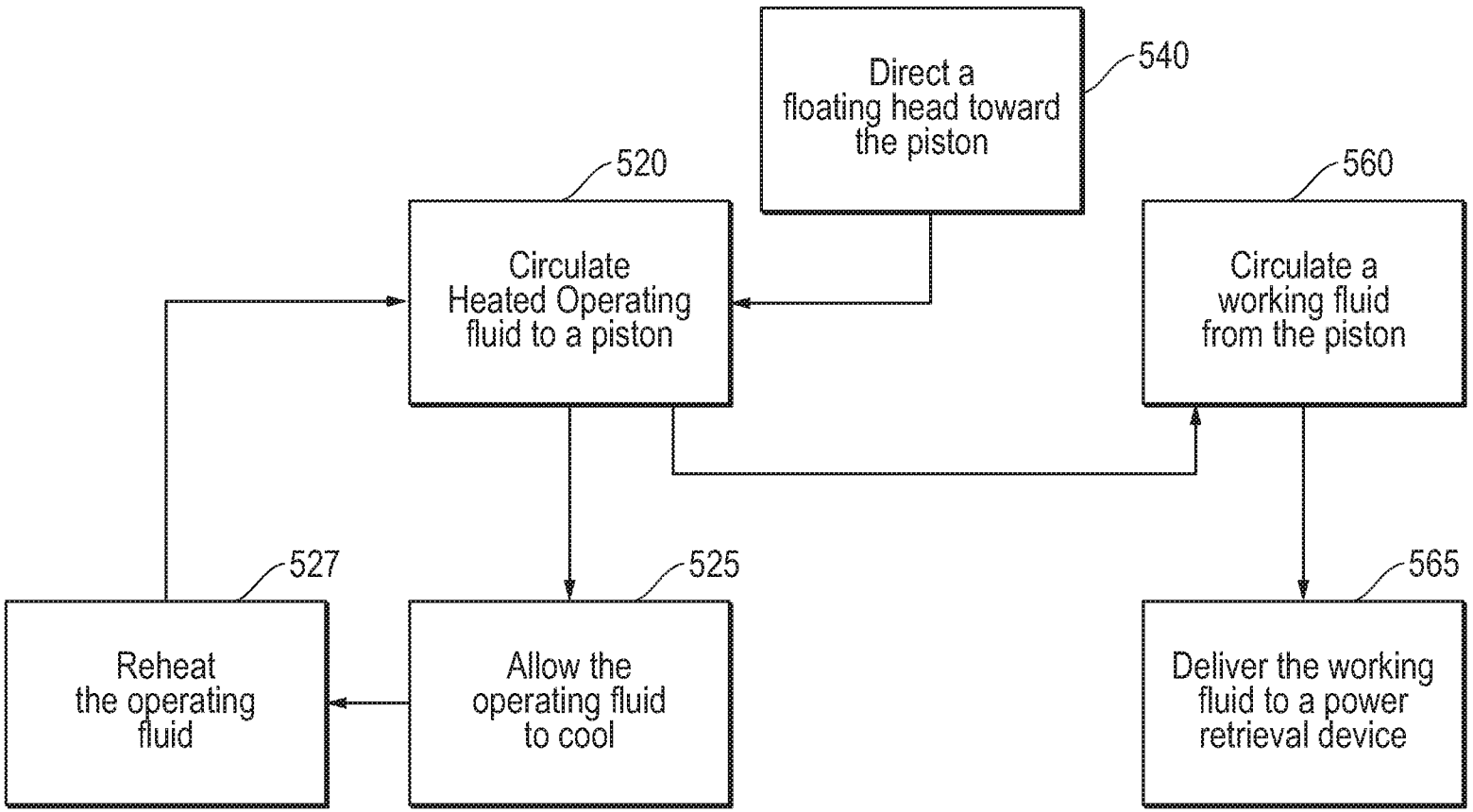
FIG. 5 is a flow-chart summarizing an embodiment of employing a floating head piston assembly in a system to produce work for supplying energy.

Referring now to FIG. 5, a flow-chart is shown which summarizes an embodiment of employing a floating head piston assembly in a system to produce work for supplying energy. Specifically, as shown at 520, 540 and 560, heated operating fluid is circulated to a piston in order to circulate working fluid from the location. At this same time, a floating head is also directed toward the piston to help facilitate these circulations. Ultimately working fluid is delivered to one of a variety of power retrieval devices as noted at 565 and thus, a functioning engine is provided. The circulating operating fluid may then be allowed to cool 525 and eventually reheated 527 to continue the cycle.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

I claim:

1. A segmented piston assembly of enhanced foot-space flexibility for a thermal cycle engine, the assembly comprising:

a piston with a piston head defining an adjacent chamber to circulate operating fluid;

a floating head defining a floating chamber and in hydraulic communication with the adjacent chamber to enhance reciprocation of the piston head, the position of the floating head dynamically correlated to a volume of the adjacent chamber;

a head chamber to accommodate the floating head and define the floating chamber; and a tailored flow restricting hydraulic line for fluid communication between the floating head and the adjacent chamber.

2. The assembly of claim 1 wherein the piston head defines an intermediate chamber to circulate working fluid for obtaining power therefrom.

3. The assembly of claim 2 wherein the working fluid is an incompressible fluid.

4. The assembly of claim 1 wherein the floating chamber is a gas-filled, isolated chamber.

5. A segmented system of enhanced foot-space flexibility and comprising:

a piston defining an adjacent chamber in hydraulic communication with a floating head defining a floating chamber by way of a tailored flow restricting hydraulic line to facilitate the communication, a position of the floating head dynamically correlated to a volume of the adjacent chamber; and a pressure volume regulator device in hydraulic communication with the floating chamber to facilitate a change in the volume of the adjacent chamber through a change in the position of the floating head.

6. The system of claim 5 wherein the piston further defines an intermediate chamber to circulate a working fluid, the system further comprising a power retrieval device to attain the circulated working fluid.

7. The system of claim 6 wherein the power retrieval device is one of a motor, a flywheel and a generator.

8. The system of claim 5 wherein the adjacent chamber is configured to circulate an operating fluid, the system further comprising a heat exchanger for heating the operating fluid.

9. The system of claim 8 wherein the operating fluid is a compressible fluid selected from a group consisting of supercritical $CO_2$, supercritical steam, supercritical helium and a non-supercritical fluid.

10. The system of claim 8 further comprising a cold exchanger for cooling the operating fluid.

11. The system of claim 10 further comprising a recuperator in hydraulic communication with each of the cold exchanger and the heat exchanger for intermediate heat recovery and temperature regulation of the operating fluid.

12. A method of obtaining power from a system, the method comprising:

circulating operating fluid to a piston of the system for reciprocation thereof;

circulating the operating fluid from the piston;

cooling the operating fluid with a cold exchanger with the aid of water at room temperature;

circulating a working fluid from the piston to a power retrieval device for the obtaining of the power in response to the reciprocation; and shifting a position of a floating head in fluid communication with the piston to enhance the reciprocation of the piston.

13. The method of claim 12 further comprising heating the operating fluid in advance of circulating to the piston.

14. The method of claim 13 wherein the heating of the operating fluid is facilitated by a heat exchanger with the aid of heated water by one of geothermal, solar and waste heat.

15. The method of claim 12 wherein the shifting of the position of the floating head comprises directing a working fluid to a floating chamber defined by the floating head from a pressure volume regulator.

16. The method of claim 15 wherein the working fluid of the pressure volume regulator is drawn from a reservoir of the system.

17. The method of claim 16 wherein the reservoir of the system is supplied with working fluid diverted from the power retrieval device.

* * * * *